US007600406B2

(12) United States Patent
Kastropil

(10) Patent No.: US 7,600,406 B2
(45) Date of Patent: Oct. 13, 2009

(54) APPARATUS FOR RECTIFYING ROUND PIPE AND TUBING

(75) Inventor: Anthony Kastropil, Croydon South (AU)

(73) Assignee: Stainless Tube Mills (Australia) Ltd. (AU)

( * ) Notice: Subject to any disclaimer, the term of this patent is extended or adjusted under 35 U.S.C. 154(b) by 259 days.

(21) Appl. No.: 10/562,477

(22) PCT Filed: Jun. 1, 2004

(86) PCT No.: PCT/AU2004/000726

§ 371 (c)(1),
(2), (4) Date: Dec. 22, 2005

(87) PCT Pub. No.: WO2004/112978

PCT Pub. Date: Dec. 29, 2004

(65) Prior Publication Data

US 2006/0174669 A1 Aug. 10, 2006

(30) Foreign Application Priority Data

Jun. 23, 2003 (AU) ..... 2003903206

(51) Int. Cl.
*B21D 3/00* (2006.01)

(52) U.S. Cl. ..... 72/78; 72/11.1; 72/12.7; 72/122

(58) Field of Classification Search ..... 72/77, 72/78, 95, 96, 98, 100, 224, 10.3, 11.1, 101, 72/122, 123, 11.6, 12.7, 12.8, 366.2
See application file for complete search history.

(56) References Cited

U.S. PATENT DOCUMENTS

| | | | | | |
|---|---|---|---|---|---|
| 3,014,519 | A | * | 12/1961 | Wright | 72/78 |
| 3,363,442 | A | * | 1/1968 | Kennedy et al. | 72/123 |
| 3,431,769 | A | | 3/1969 | Hajikano | |
| 3,795,126 | A | * | 3/1974 | Semenenko et al. | 72/78 |
| 4,057,992 | A | | 11/1977 | Willimzik | 72/283 |
| 4,242,894 | A | | 1/1981 | Von Dorp et al. | 72/96 |
| 4,494,394 | A | | 1/1985 | Nilsson | 72/98 |
| 4,711,112 | A | | 12/1987 | Nilsson | 72/98 |
| 4,712,407 | A | * | 12/1987 | Yoshiki et al. | 72/68 |
| 4,736,607 | A | * | 4/1988 | Wochnik | 72/177 |
| 4,763,504 | A | * | 8/1988 | Nilsson | 72/98 |
| 4,827,749 | A | | 5/1989 | Staat et al. | 72/96 |

(Continued)

FOREIGN PATENT DOCUMENTS

DE 2301301 7/1974

(Continued)

*Primary Examiner*—Edward Tolan
(74) *Attorney, Agent, or Firm*—Edmonds Nolte, PC

(57) ABSTRACT

Apparatus for reducing the diameter, rounding or straightening of pipe or tubing by rolling comprising a plurality of cylindrical rollers arranged in a parallel-cylindrical array through which the pipe or tubing is passed, the rollers being skewed to displace their central contact zones radially inwards bringing them into forceful contact with the external surface of the pipe or tubing, and being rotated to cause the central contact zones to describe helical paths along the external surface of the pipe or tubing. Thereby to progressively apply locally to the whole of the external surface of the pipe or tubing a compressive force in excess of the yield strength of its material, causing the pipe or tubing to adopt a set at a smaller diameter.

20 Claims, 7 Drawing Sheets

U.S. PATENT DOCUMENTS

| | | | | |
|---|---|---|---|---|
| 5,477,717 | A | 12/1995 | Skrebergene | 72/49 |
| 5,477,719 | A | 12/1995 | Akiyama et al. | 72/97 |
| 5,533,370 | A | 7/1996 | Kuroda et al. | 72/12.5 |
| 5,642,638 | A * | 7/1997 | Pietsch et al. | 72/98 |
| 6,233,991 | B1 | 5/2001 | Thimmel et al. | 72/84 |
| 6,968,719 | B2 * | 11/2005 | Zifferer | 72/96 |

FOREIGN PATENT DOCUMENTS

| | | |
|---|---|---|
| EP | 0550256 | 7/1993 |
| GB | 2144358 | 3/1985 |
| SU | 567235 | 12/1984 |

* cited by examiner

APPARATUS FOR RECTIFYING ROUND PIPE AND TUBING

NATIONAL STAGE APPLICATION UNDER 35 USC 371

This is a National Stage application under 35 USC 371 of PCT/AU2004/000726, filed 23 Jun. 2003.

FIELD OF THE INVENTION

This invention relates to a method and apparatus for rectifying by reduction the diameter of round pipe or tubing with the secondary effects of straightening and rounding. More particularly, it relates to such methods and apparatus employing for the purpose a plurality of rollers.

BACKGROUND OF THE INVENTION

For a variety of reasons, in the fabrication of pipe and tubing by rolling up a tubular form from a flat strip or skelp and seam welding the abutting edges, it is impossible to maintain precise control of the finished diameter. Particularly in larger diameters and where lighter gauge material is used, for example in diameters above 150 millimetres or where the wall thickness is less than 2% of diameter, pipe and tubing fabricated in this way may not be perfectly round. Some variation from straightness is also frequently experienced. It is well known that standards for some forms of pipe and tubing prescribe quite liberal tolerances.

Many applications exist in which pipe and tubing must meet precise specifications in relation to diameter, roundness and straightness and a variety of methods has therefore been developed to correct defects in these criteria. Where the diameter of pipe or tubing has to be increased, it is common to pass a cylindrical die of some suitable hard material and having an external diameter somewhat greater than the internal diameter of the pipe or tube through the lumen of the pipe or tube to stretch it. Where more than a minor correction is required, consecutive passes of dies of increasing diameter may be required, the internal surfaces of the pipe or tube lumen may require lubrication, scoring of the internal surfaces is common and some degree of wall thinning will occur. The process has the advantage of being operable on a continuous basis. In another method, the internal diameter of pipe or tubing is increased by subjecting the interior of short lengths to hydraulic pressure to expand it into an enclosing female die. Use of this method is normally confined to short lengths of pipe or tubing and has the disadvantages of slowness and the fact that it cannot be operated on a continuous basis. Both methods are well known in the art.

Where the diameter of pipe or tubing is required to be decreased, it is common to roll it down by passing the pipe or tubing through a plurality of concave rollers arranged such that their diameters extended meet at a common point and with their collective concavities more or less forming a complete circle slightly smaller than the final diameter of pipe or tubing required. Equally-spaced rollers are supported on shafts parallel to tangents to the surface of the pipe and tubing and are driven in rotation while the pipe or tubing to be resized is fed between them and is thereby cold worked to a smaller diameter. Unless the pipe or tubing is stretched at the time, some degree of wall thickening will occur.

One example of this method appears intended for use with only pipe or tubing of smaller diameters and the fact that the method includes a provision for final sizing to be performed by drawing the rolled pipe or tube through a female sizing die is indicative of the limited control of worked diameter available. During this method only relatively small decreases in diameter may be achieved in a single pass, normally of the order of 0.2 to 0.4 mm, that what is effectively a wiping action of the sides of the roller concavities may scuff or mar the external surfaces of pipe or tubing (an important factor in stainless steel products), and the fact that the method is relatively ineffective in large, relatively thin-walled pipe or tubing. The scuffing or marring of external surfaces is particularly pronounced in larger diameter pipe or tubing where the method is normally performed using only two rollers having deep concavities. Obviously, as suggested in the example cited, the diameter of pipe or tubing may be reduced by drawing it through a female sizing die. Where this method is employed, the pipe or tube may require lubrication, the external surface of the pipe or tubing is frequently scored by asperities in the die or picked up by the die and some wall thickening and elongation may occur. In another method, both internal and external dies are used in what is normally a second or third manufacturing operation.

Another example of diametral reduction by rolling, a short length of pipe or tubing is rotationally supported by clamps only at the ends and a plurality of cylindrical rollers is brought to bear against the outer surface of the length of pipe or tubing while it is rotated, thereby reducing its diameter and, if required, rendering it into tapered form. The method is applicable only to short lengths of pipe or tubing and obviously cannot be operated as a continuous process. Of relevance is a method in which thin-walled metallic tubing is formed from a solid blank in an Assel rolling mill. In this case, provision is made to vary the wall thickness of the formed tubing by adjusting the radial positions of a plurality of forming rollers. Adjustment is effected by increasing the skew of short shafts upon which the forming rollers are rotationally supported, thereby radially displacing the rollers inwardly or outwardly. The ends of the short shafts are rotationally supported in suitable bearings accommodated within the ball parts of ball and socket joints, which ball parts move in complementary sockets to permit skewing of the shafts. The rollers are short and are provided with shoulders which work on the blank from which the tubing is formed.

In many tube rolling methods, a mandrel is inserted into the lumen of a tube to be rolled and the tube worked by a plurality of rollers against the mandrel. Applications are also common in which laminated pipe or tubing is made by drawing one piece of pipe or tubing into the lumen of another. Where, for example, the inner pipe or tube is made from a polymer material, it is common to temporarily reduce its diameter by passing it between concave rollers or through a female sizing die in the manner described and, when positioned inside a pipe or tube of larger diameter, expanding it by the application of internal fluid pressure to make a tight fit within the outer pipe or tube. Additionally, to ensure a more secure capture of the inner pipe or tube, the outer pipe or tube may subsequently be reduced in diameter using one of the methods described. Where both the inner and outer pipes or tubes are of metal, the inner is captured simply by reducing the diameter of the outer.

SUMMARY

The present invention provides a method and apparatus for reducing the diameter of pipe or tubing; that is precisely adjusted to produce an accurate finished diameter. The method and apparatus may be used with either continuous or discrete lengths of pipe or tubing. As a result of using the method and apparatus, a straightening effect is achieved without marring the external surface of the pipe or tubing. Using this invention provides a greater degree of reduction in diameter in a single pass than other systems resulting in properly rounded pipe or tubing properly round without the necessity to lubricate the pipe or tubing. The method and system are effective in treating a full range of diameters in both thin and thick-walled pipe or tubing.

In one aspect of the present invention, the diameter of pipe or tubing is reduced by passing it through a rotating apparatus comprising a supporting cylinder in which is provided a plurality of closely and equally-spaced, skewed, long, narrow, parallel cylindrical rollers of a rigid, hard material. The skewed rollers are brought to bear on the external surface of the pipe or tubing as it passes through the apparatus. The rollers comprise a first and second end and are supported in a cylindrical array with their ends on pitch circles of equal diameter and are rotationally supported in suitable bearings provided in first and second end flanges of the supporting cylinder. The first and second end flanges are provided with apertures to permit the ingress and egress of the pipe or tubing to be treated.

One or both or the end flanges are capable of rotational displacement within the ends of the supporting cylinder, thereby adjusting the degree of skew of the rollers which, although they are displaced relative to the longitudinal axis of the supporting cylinder, remain in planes parallel to the longitudinal axis. The bearings of the rollers are themselves supported in part-spherical bushings which are, in turn, accommodated within complementary cups formed in the end flanges such that the rollers may continue to be rotationally supported in the end flanges when in their skewed positions. The supporting cylinder is itself rotationally supported in one or more bearings which permit it to rotate about its longitudinal axis, driven by a suitable driving motor.

In operation, the degree of skew of the rollers is adjusted to bring narrow, centrally-located contact zones of the rollers to bear against the outer surface of the pipe or tubing with a desired force. As the pipe or tubing passes at a steady speed through the cylindrical array of rollers, the supporting cylinder is rotated by its driving motor, causing the contact zones of the rollers to describe continuous, parallel, overlapping, helical paths along the external surface of the pipe or tubing, locally applying a compressive force to the pipe or tubing in excess of the yield stress of its material and thereby causing the pipe or tubing to adopt a set at a smaller diameter. The passage of the contact zones of the rollers over the outer surface of the pipe or tubing causes the surface to be attractively burnished without marring, any out-of-roundness of the pipe or tubing is simultaneously corrected and, should the pipe or tubing require straightening, its restraint in correct alignment as it passes through the rollers will effect this.

BRIEF DESCRIPTION OF DRAWINGS

The various aspects of the present invention will be more readily understood by reference to the following description of preferred embodiments given in relation to the accompanying drawings in which.

DETAILED DESCRIPTION OF DRAWINGS

Figures 1A, 1B, 1C:
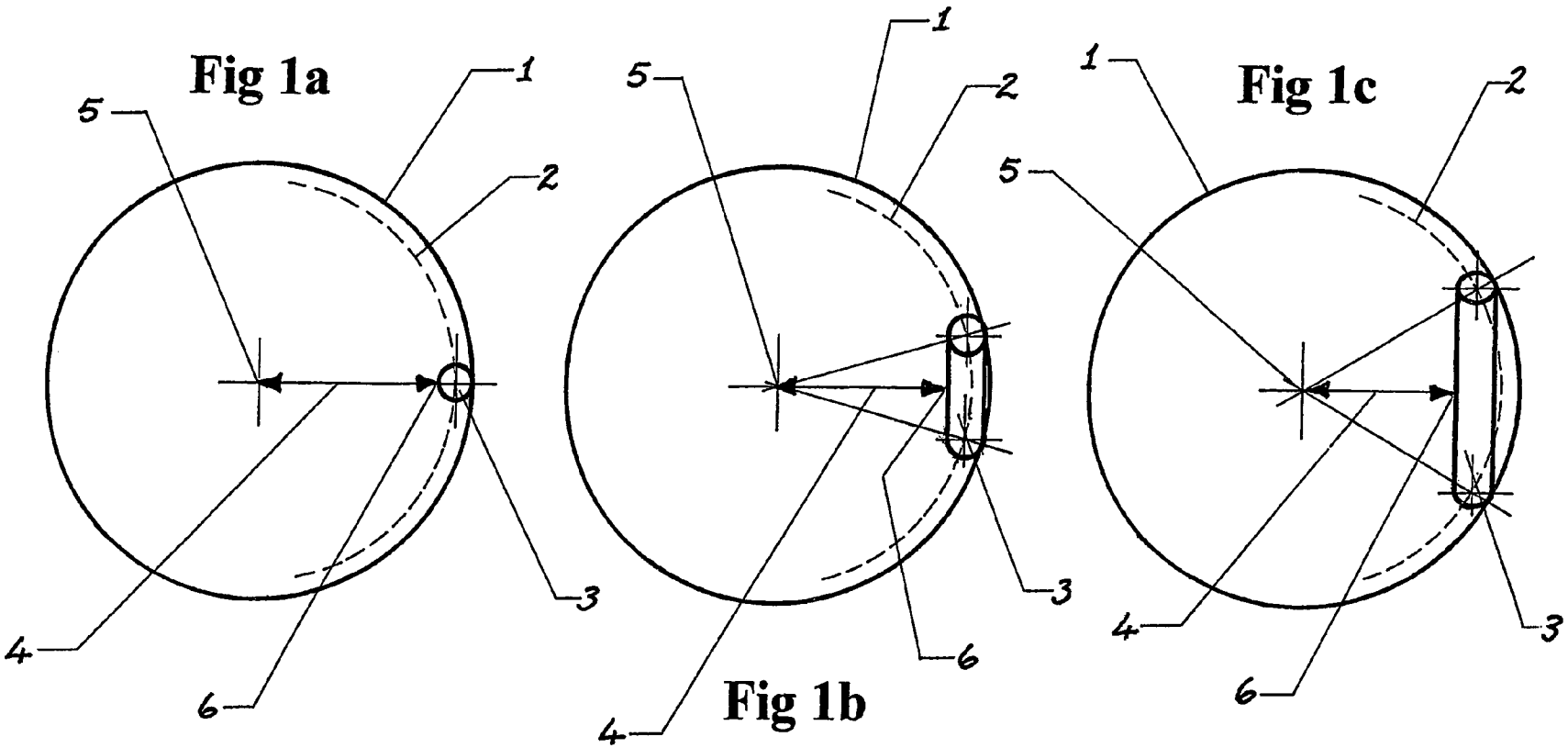
FIGS. 1*a*, 1*b* and 1*c* are partial cross-sectional views of the supporting cylinder showing various positions of one of the cylindrical array of the rollers.

With reference to FIG. 1*a*, roller 3 is rotationally supported within supporting cylinder 1 with its axis positioned on pitch circle 2 and parallel to the axis of the supporting cylinder. With reference to FIG. 1*b*, the same roller is shown with its ends skewed 15° either side of the previous position. It can be seen that the distance 4 from the centre 5 of the supporting cylinder to contact zone 6 of the roller has been reduced. With reference to FIG. 1*c*, the roller is shown with its ends skewed a further 15° and distance 4 can be seen to have been further shortened. It may be appreciated from the figures that skewing of the rollers may be employed to bring their central contact zones into forceful contact with the outer surface of the pipe or tubing to be treated. Obviously, the rollers may be made solid throughout their lengths or made with solid ends and partially hollow in their middle parts.

Figure 2:
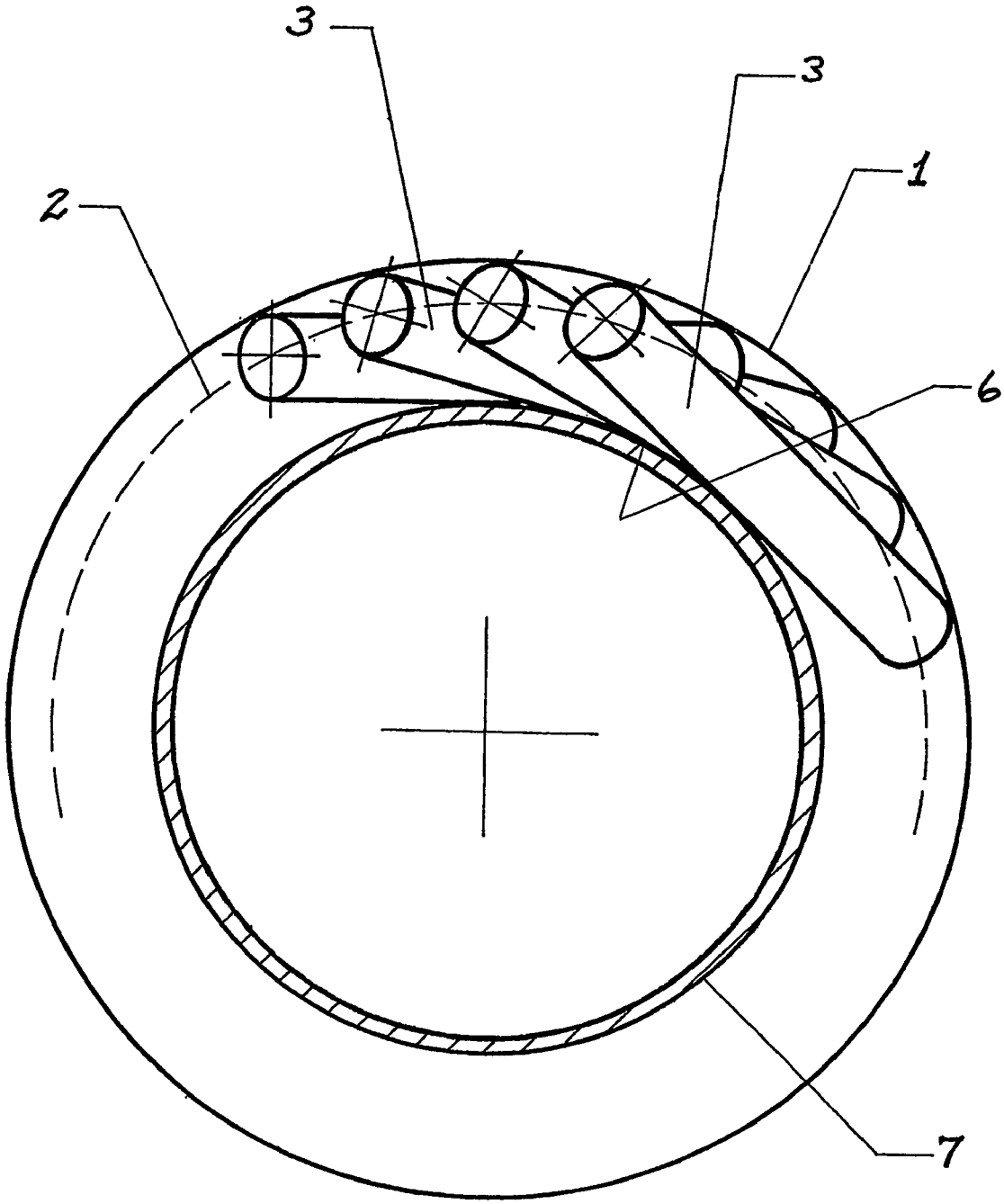
FIG. 2 is a partial cross-sectional view of the supporting cylinder and the pipe or tubing to be treated showing the arrangement of some of the cylindrical array of the rollers in relation to the pipe or tubing to be treated.
Figure 12:
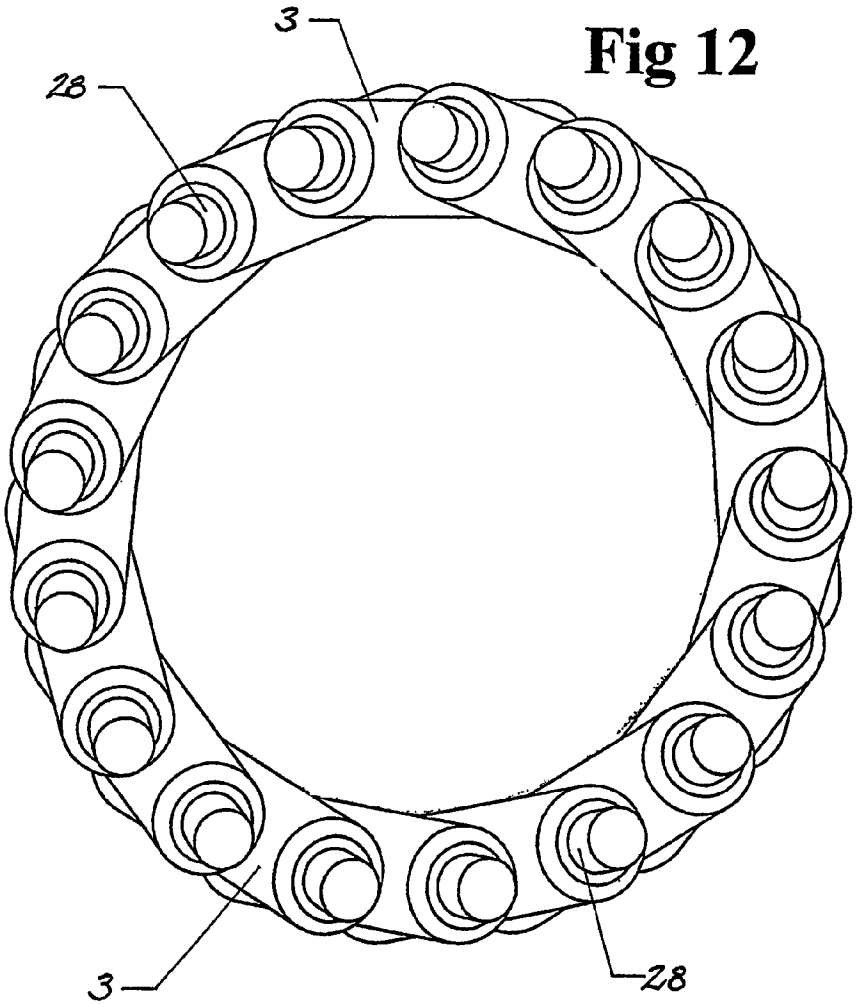
FIG. 12 is an end view of the set of the rollers depicted in FIG. 11.
Figure 11:
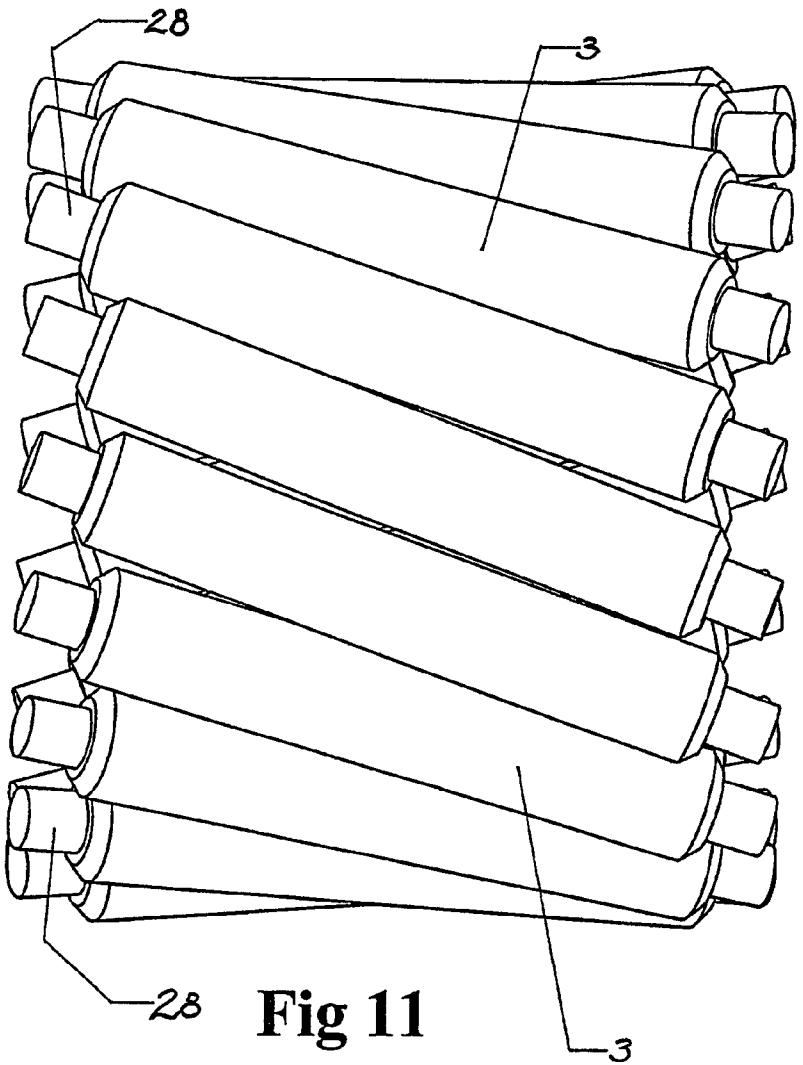
FIG. 11 is a side view of a typical set of the rollers in cylindrical array with all supporting means deleted for clarity of presentation.

With reference to FIGS. 2, 11 and 12, partial and complete sets of rollers 3 in cylindrical array are depicted, the rollers being rotationally supported within supporting cylinder 1 with their axes ends positioned on pitch circles 2 of equal diameter. Skewing of the rollers has brought contact zones 6 into contact with the external surface of pipe or tubing to be treated 7. In the preferred embodiment, the rollers are made with a minimum practical diameter commensurate with a particular application in order to provide the maximum number of rollers in each the cylindrical array. This normally results in the rollers having a diameter approximately 20% of that of the pipe or tubing to be treated, for example, 18 rollers with a diameter of 28 millimetres are used in an arrangement to treat pipe or tubing with a diameter of 150 millimetres.

Figure 3:
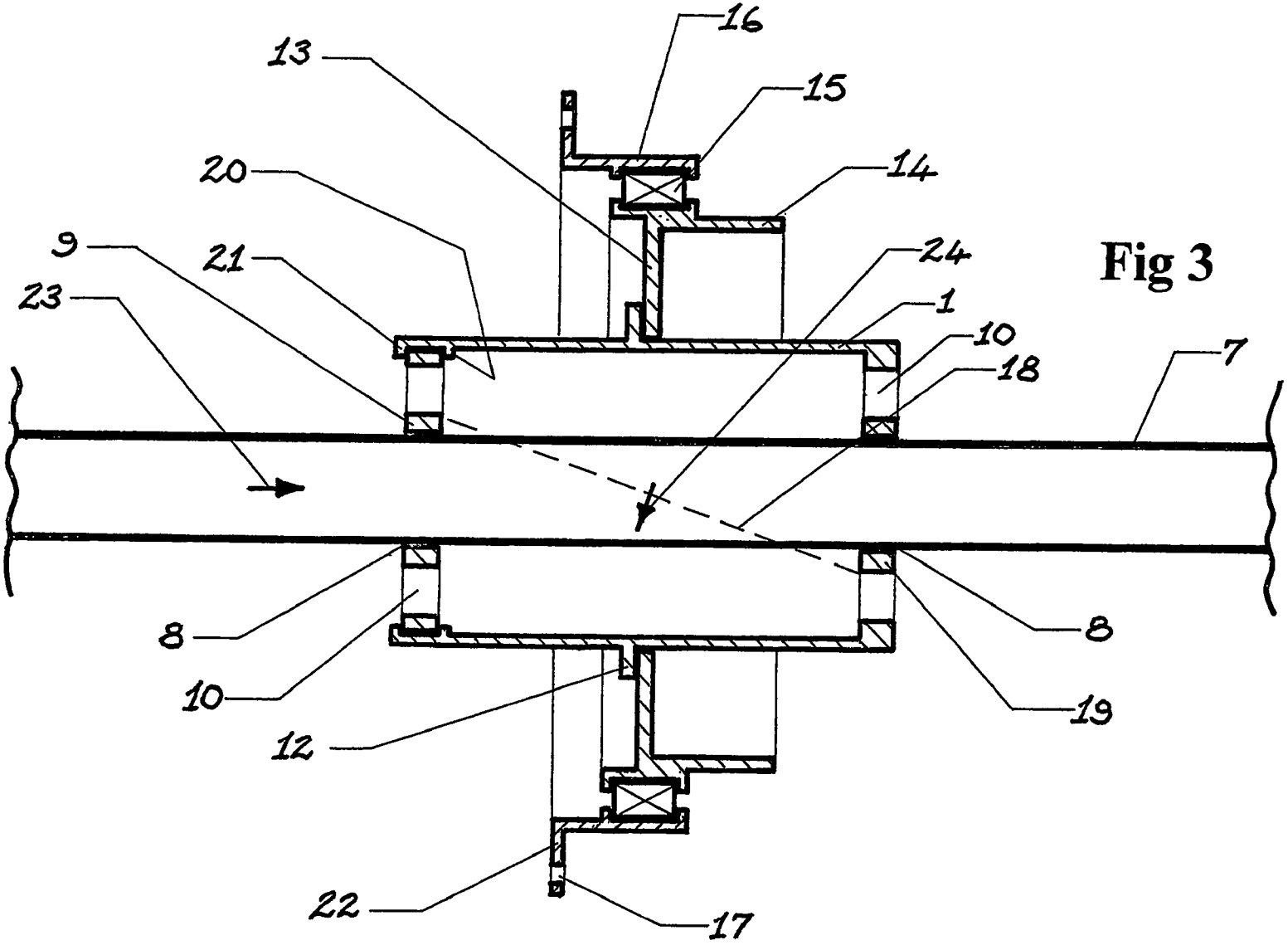
FIG. 3 is a longitudinal cross-sectional view of the supporting cylinder, its supporting bearing and the pipe or tubing to be treated, the rollers having been deleted for clarity of presentation.

With reference to FIG. 3, pipe or tube to be treated 7 is depicted passing through tube-pass apertures 8 in end flanges 9, 19 of supporting cylinder 1 in the direction shown by arrow 23. A typical position of the axis of one of the cylindrical array of rollers is depicted by broken line 18, supporting provisions for this roller in end flanges 9, 19 having been cut away in the figure. End flange 19 is fixed in one end of the supporting cylinder and end flange 9 is captured in the other end of the supporting cylinder between shoulders 20, 21 while remaining free to be displaced in a rotational sense to effect skewing of the rollers. Supporting provisions (not shown) for the ends of the rollers are accommodated in support apertures 10 provided in the supporting cylinder end flanges. Mounting flange earing 15 is positioned on or close to a plane passing through the contact zones of the rollers. Mounting flange 12 is provided on the mid exterior surface of the supporting cylinder and attached to this with suitable fastening means is radial web 13, the periphery of which is formed into an inner part of a housing for bearing 15. Cylindrical pulley 14 is formed on one side of the radial flange positioned towards its periphery. Radial mounting flange 22 is provided with holes 17 for mounting attachments (not shown) and its inner periphery is formed into a cylindrical extension 16 which incorporates an outer part of a housing for bearing 15. Mounting flange 22 is fixed with suitable fastenings to a supporting structure (not shown) and supporting cylinder 1 is driven in a rotational sense by drive forces applied to pulley 14 through a suitable belt (not shown).

In alternative embodiments, the pulley is replaced with a sprocket or gear (not shown) and the supporting cylinder is driven in a rotational sense by drive forces applied through one or more suitable chains or gears. As pipe or tubing to be treated 7 passes through the interior of the supporting cylinder and through the rotating cylindrical array of rollers (not shown), the contact zones of the rollers pass over the external surface of the pipe or tubing following continuous, parallel, overlapping, helical paths a typical one of which is indicated by arrow 24. It can be readily demonstrated that the power required to drive the rollers against the pipe or tubing is quite low and, even when the pipe or tubing is being heavily worked, is normally considerably less than the power required by conventional methods.

Figure 4:
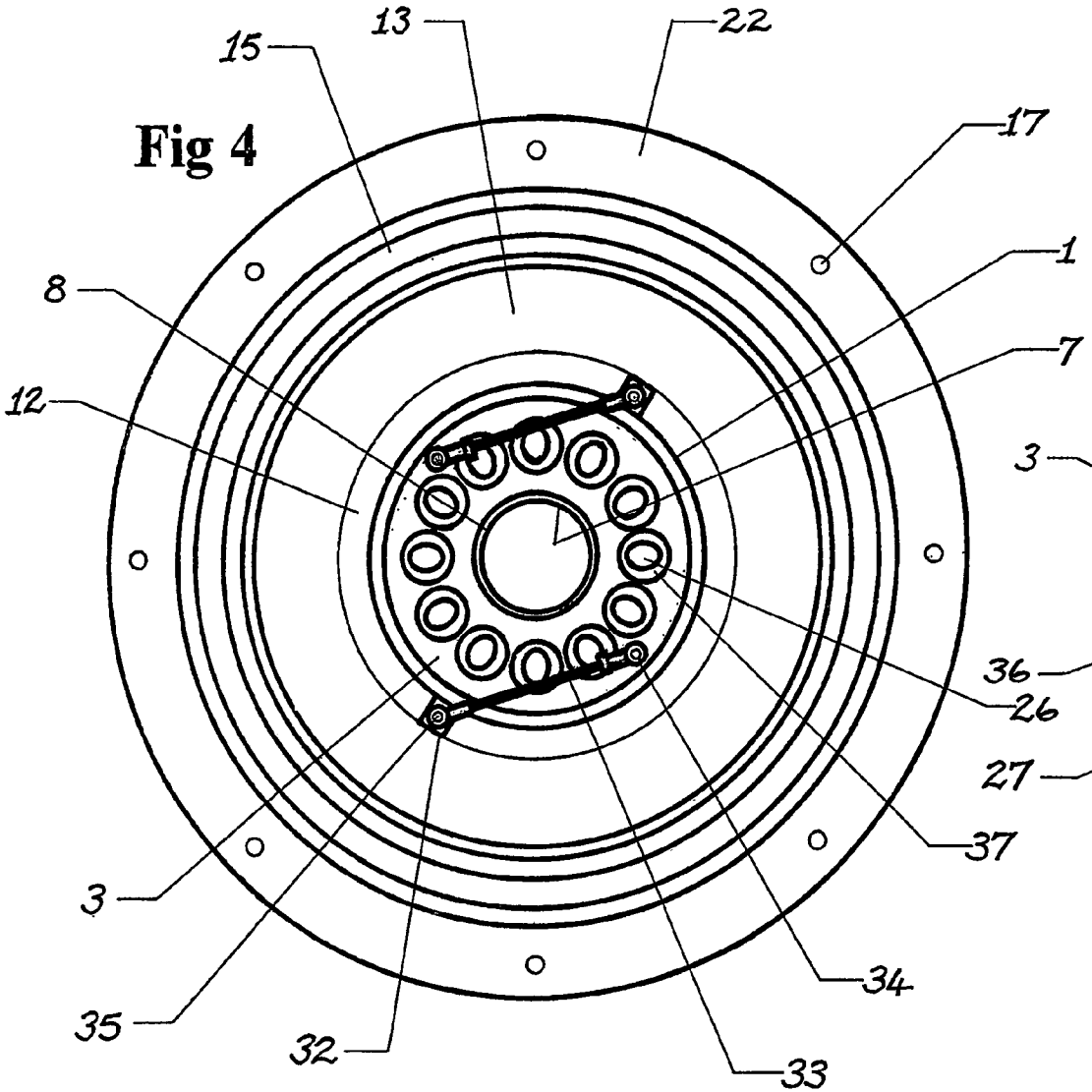
FIG. 4 is an end view of the components depicted in FIG. 3.

With reference to FIG. 4, end flange 9 is restrained in a rotational sense by adjustable-length struts 33, the inner ends of which are pivotally attached to short shafts 34 formed on end flange 9 and the outer ends of which are pivotally attached to short shafts 35 formed on the ends of posts 32 fixed to the end exterior surfaces of the supporting cylinder. Skewing of the rollers is effected by lengthening or shortening the struts, thereby displacing end flange 9 in a rotational sense relative to the supporting cylinder.

Figure 5:
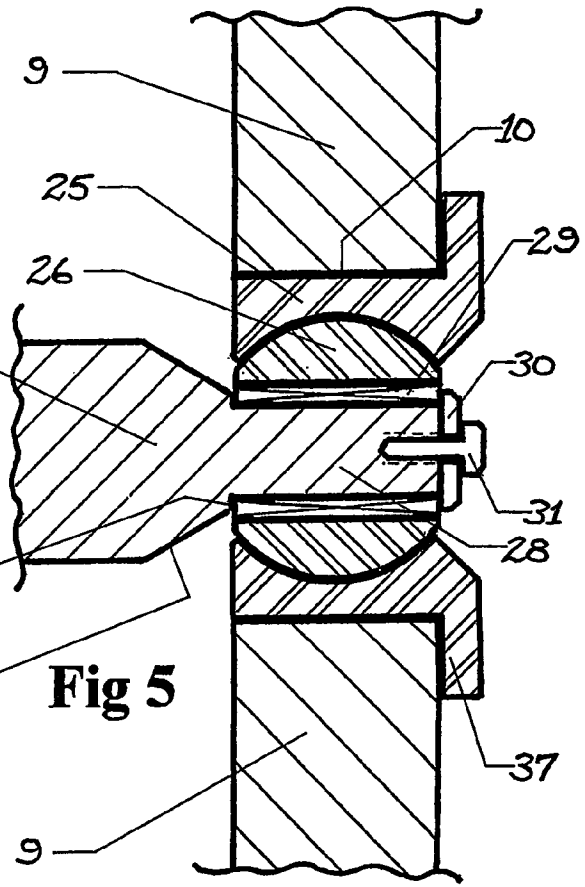
FIG. 5 is a longitudinal cross-sectional view of supporting means at one end of one of the rollers.

With reference to FIG. 5, the ends of rollers 3 are provided with tapered section 27, the end of which is formed into shaft 28. Shaft 28 is rotationally accommodated in needle bearing 29 which is, in turn, accommodated within part-spherical bushing 26. Part-spherical bushing 26 is accommodated within split cup 25 which is, in turn, accommodated within support aperture 10 provided in end flange 9. Bearing 29 is captured on shaft 28 between shoulder 36 and retaining cap 30, the retaining cap being fixed to the end of the shaft by suitable fastening 31. Suitable means (not shown) are provided for the lubrication of the roller support means. The split cup is provided with external flange 37 by means of which the split cup is retained in place in aperture 10 by suitable attachment means (not shown). The openings on either side of the split cup are suitably relieved to provide the requisite freedom of movement of roller 3. Shaft 28 and needle bearing 29 are made sufficiently long to accommodate the axial displacement of roller 3 caused by an increase or decrease in its degree of skewing. In an alternative embodiment (not shown), shaft 28 and needle bearing 29 are positively captured in part-spherical bushing 26 and the axial displacement of roller 3 caused by an increase or decrease in its degree of skewing is accommodated by axial displacement of end flange 9 within the end of supporting cylinder 1, the end flange being restrained against rotational displacement relative to the supporting cylinder by suitable splines, lugs or the like (not shown) on one engaging complementary provisions on the other.

Figure 6:
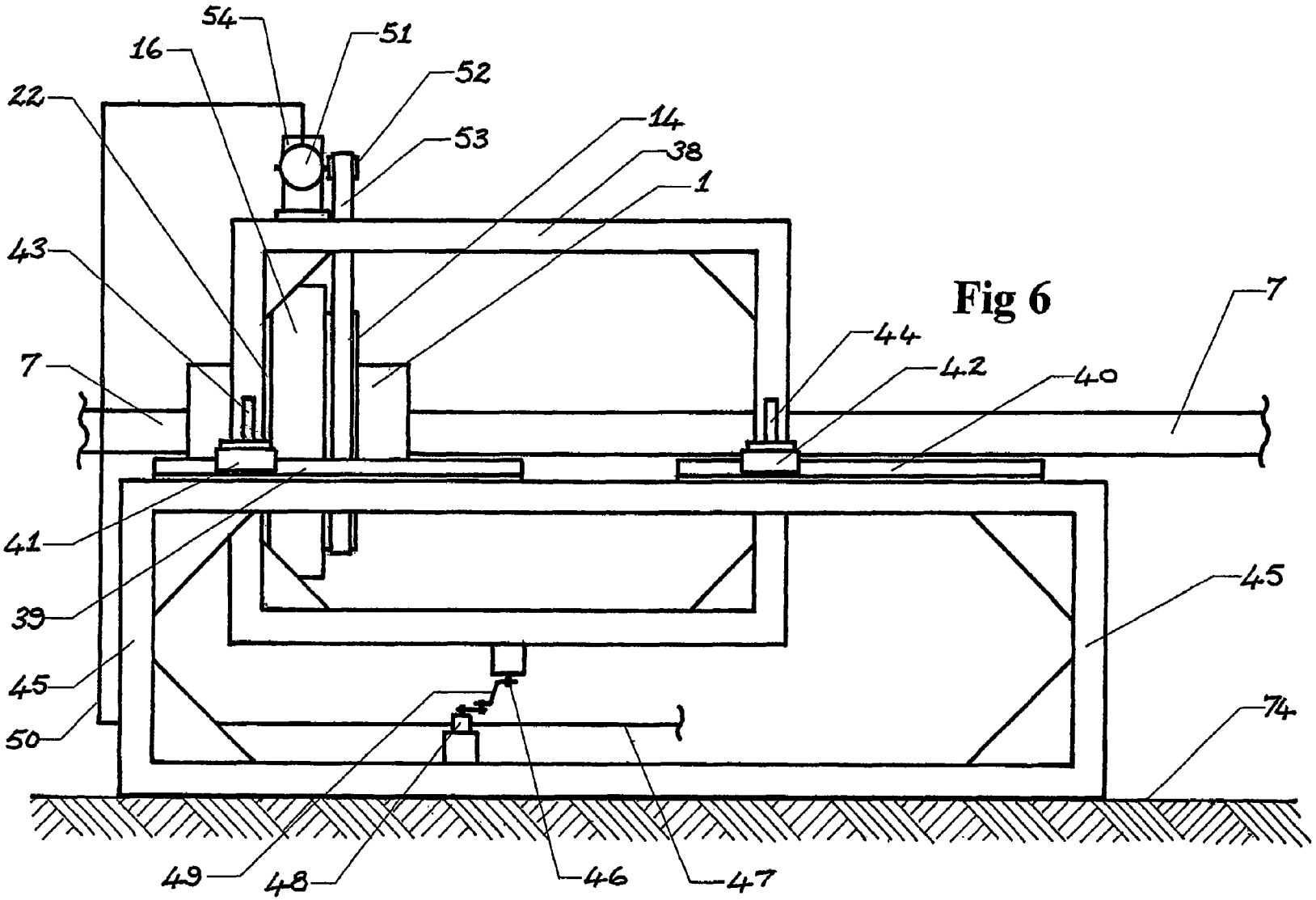
FIG. 6 is a side view of the complete apparatus with the pipe or tubing to be treated passing through it.

With reference to FIG. 6, the assembly depicted in FIGS. 3 and 4 are mounted in moving frame 38. The moving frame is slidingly supported by brackets 43, 44 bearing upon linear bearings 41, 42 travelling on rails 39, 40 fixed to upper surfaces of fixed frame 45. Pipe or tubing to be treated 7 is depicted passing through supporting cylinder 1 and its extension is supported on suitable supports (not shown). Pivot shaft 46 is fixed to a lower structural member of the moving frame towards one of its sides and valve 48 is fixed to a lower structural member of the fixed frame towards the second side of the moving frame. Link 49 connects the operating lever of the valve to the pivot shaft such that, as the moving frame is displaced along rails 39, the valve is progressively opened, the valve being fully closed at the left-hand limit of travel (as depicted) of the moving frame. A supply of compressed air at a suitable pressure is connected to the valve through air line 47 and air is supplied from the valve through flexible air line 50 to air motor 51. The air motor drives pulley 52 through reduction gearbox 54, the pulley being connected to pulley 14 by belt 53 to drive supporting cylinder 1 in a rotational sense. Suitable gusseting is provided, as required, to stiffen the moving and fixed frames. In operation, as the pipe or tubing passes into the apparatus from a tube forming mill, frictional forces applied through the contact zones of the rollers act to displace the moving frame along rails 39, 40, thereby partially opening valve 48 and actuating air motor 51 to drive supporting cylinder 1 in a rotational sense. Progressive displacement of the moving frame occurs until the air motor has reached a speed of operation matched to the speed of advance of the pipe or tubing. Further displacement of the moving frame then ceases. If the speed of advance of the pipe or tubing is reduced for some reason, the forces generated by the rollers upon the pipe or tubing act to displace the moving frame back towards its rest position, thereby closing valve 48 somewhat and reducing the speed of operation of air motor 51 and thereby the speed of rotation of supporting cylinder 1.

Figures 7, 8, 9, 10:
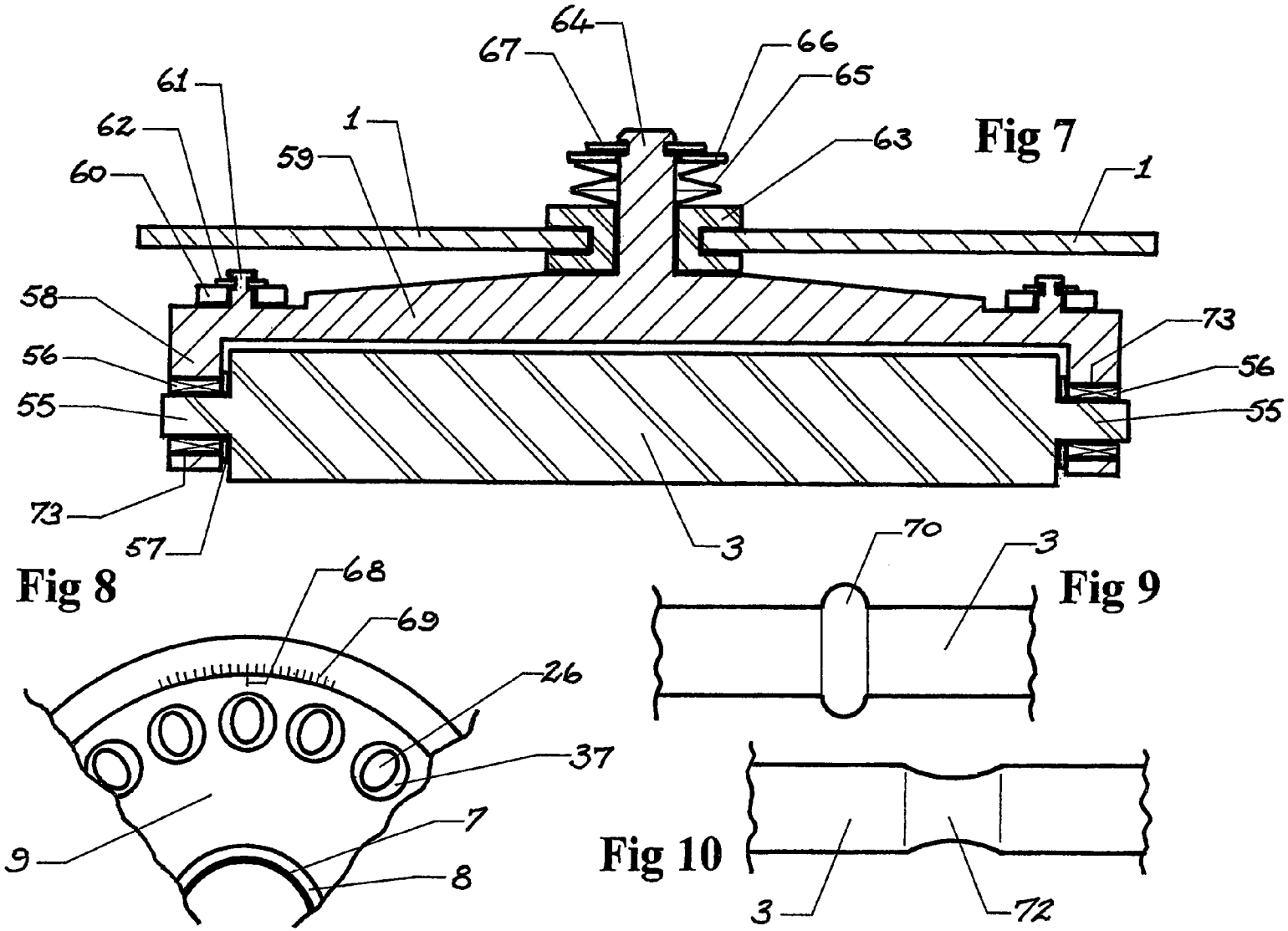
FIG. 7 is a longitudinal cross-sectional view of an alternative means of supporting the rollers.
FIG. 8 is an end view of the supporting cylinder showing calibration detail.
FIG. 9 is a partial side view of the central part of one the roller showing alternative shaping detail.
FIG. 10 is a partial side view of the central part of one the roller showing another alternative shaping detail.

With reference to FIG. 7, in an alternative embodiment, rollers 3 are rotationally supported in needle bearings 56 accommodated in bores 73 provided in shoulders 58 formed on the ends of mounting yokes 59. Each the mounting yoke is supported on a mounting yoke shaft 64 pivotally supported in bearing 63 provided in the wall of supporting cylinder 1 and is retained in place by belville washers 65, washer 66 and circlip 67 or other suitable fastening. The rollers in the cylindrical array are simultaneously skewed by force applied through skewing rings 60 which are pivotally connected to pivots 61 provided on the ends of the yoke and retained in place by circlips 62. Thrust washers 57 are provided between the ends of rollers 3 and the inner surfaces of shoulders 58. The supporting cylinder is increased in diameter as required to accommodate the arrangement described. The arrangement described is obviously suited for treating only one diameter of pipe or tubing and, in an alternative embodiment (not shown) used to treat differing diameters, the outer parts of shafts 64 are suitably threaded to engage ball nuts which are actuated by one or more suitable stepper motors to simultaneously displace all the rollers radially inwards or outwards. The use of ball screw and nut arrangements in such applications is well known and obvious.

With reference to FIG. 8, index mark 68 is provided on the face of end flange 9 and calibration marks 69 are provided on the end of supporting cylinder, the marks facilitating the adjustment of skew of the rollers. Obviously, the arrangement described is optionally able to be reversed.

With reference to FIG. 9, in an alternative embodiment, roller 3 is provided with a centrally-located, narrow, convex part 70 to permit a more localised force to be provided by the roller to the pipe or tubing to be treated.

With reference to FIG. 10, in an alternative embodiment, roller 3 is provided with a centrally-located, concave part 72 to permit a more dispersed force to be provided by the roller to the pipe or tubing to be treated.

With further reference to FIG. 6, the fixed frame is fixed to floor 74 with suitable fastenings. Where required, the fixing provisions incorporate jacking means (not shown) to precisely align the apparatus with the axis of pipe or tubing 7 emerging from a tube forming mill (not shown). The jacking means may be operated to create a straightening effect of the pipe or tubing. In a first embodiment, the jacking means are manually operated. In an alternative embodiment, sensors (not shown) are employed to detect the straightness or not of the pipe or tubing and, as required, one or more stepper motors (not shown) are employed to operate the jacking means to correct any deviation from straightness. A programmable logic controller or other microprocessor-based device is employed to process data from the sensors and control the operation, as required, of the stepper motors. In another alternative embodiment (not shown), the fixed frame is permanently fixed to floor 74 and mounting flange 22 is supported on linear bearings slideably travelling on rails fixed to the vertical members of the moving frame, the linear bearings being displaced by ball screw and nut arrangements driven by one or more stepper motors. The stepper motors are employed to drive the ball screw and nut arrangements to correct any deviation of the pipe or tubing from straightness. A programmable logic controller or other microprocessor-based device is employed to process data from the sensors and control the operation, as required, of the stepper motors.

With reference to FIGS. 3 and 6, in an alternative embodiment (not shown), air motor 51 is mounted directly to cylindrical extension 16 and drives supporting cylinder 1 in a rotational sense through one or more belts, chains or gears engaging pulleys, sprockets or gears formed on pulley 14 or on the external surface of supporting cylinder 1. In this embodiment, the moving frame is redundant and the apparatus is simply fixed to vertical members of the fixed frame. In other alternative embodiments (not shown), the air motor is replaced by another form of drive motor in the form of an hydraulic motor, a stepper motor or other form of speed-controllable electric motor. In this arrangement, the speed of advance of the pipe or tubing is detected by one or more encoders attached to forming rollers on the tube forming mill or on a jockey wheel which travels on the pipe or tubing. A programmable logic controller or other microprocessor-based device is employed to process data from the encoders and control the operation, as required, of the drive motor driving the supporting cylinder in a rotational sense.

In an alternative embodiment (not shown), the apparatus is made in multi-stage form with two or more of the units operated in tandem such that one of each or all units are employed to reduce the diameter of the pipe or tubing, correct its out-of-roundness or straighten it. The units are optionally operated with a common direction of rotation or with alternate units rotating in the opposite sense. It will be appreciated from further inspection of FIGS. 1*a*, 1*b*, 1*c* and 2 that the axes of the cylindrical arrays of rollers of consecutive units, regardless of their adjustments, will always be collinear. At the same time, the speed of advance of the pipe or tubing through consecutive units will be correct regardless of the skewing adjustment of the rollers. This is a result of the fact that, as the degree of skew of the rollers is increased, which would tend to increase the axial component of the vector triangle representing speed of advance of the pipe or tubing, the rotational component is automatically decreased in compensation. As a result, the apparatus is very well suited for operation in multi-stage form. It should be noted also that the axial forces imparted to the pipe or tubing by operation of the apparatus are high and no other means of propulsion or urging in an axial sense are required to be applied to the pipe or tubing during its passage through the apparatus. In multi-stage arrangements of the apparatus, the axial forces applied by it to the pipe or tubing are optionally employed to draw material through a tube forming mill positioned upstream of the apparatus and significantly reduce the power required to drive the tube forming mill. Obviously, the apparatus may optionally be employed to work upon continuous lengths of pipe or tubing delivered directly from a tube forming mill or upon discrete lengths of pipe or tubing loaded sequentially into the apparatus.

With further reference to FIG. 4, in an alternative embodiment (not shown), one or more stepper motors mounted on the external surface of supporting cylinder 1 are employed to adjust the lengths of suitable ball screw and nut arrangements (not shown) used in place of adjustable-length struts 33. Sensors are provided to detect the precise corrected diameter of the pipe or tubing and a programmable logic controller or other microprocessor-based device is employed to process data from the sensors and control the operation, as required, of the stepper motors. Power and control signals are supplied to the stepper motors through slip-ring provisions and control signals are optionally transmitted through wireless connections.

Sensing means in the form of opposed pairs of rollers attached to the inner ends of radially-arranged linear transducers are employed to measure the finished diameter of the pipe or tubing emerging from the apparatus, the rollers being urged into contact with the pipe or tubing by suitable springs. In a second embodiment, sensing means in the form of a laser micrometer are employed to measure the finished diameter of the pipe or tubing emerging from the apparatus. In a third embodiment, sensing means in the form of opposed pairs of proximity sensors, each the sensor measuring the gap between its reference surface and the external surface of the pipe or tubing are employed to measure the finished diameter of the pipe or tubing emerging from the apparatus.

With further reference to FIG. 3, it will be readily appreciated that supporting cylinder 1 with its the roller array may be made to be readily detachable from radial web 13 through the use of quick-release attachments (not shown) and a replacement the supporting cylinder with its the roller array installed in its place to accommodate the pipe or tubing of a different diameter.

The rolling process performed by the apparatus provides accurate control of the external diameter of pipe or tubing; it requires no lubrication of the external surface of the pipe or tubing; it requires only low power for its operation; it leaves the external surface of the pipe or tubing burnished and easily polished; it is not limited by the diameter, length or wall thickness of the pipe or tubing; it may be operated with a greater lineal speed of the pipe or tubing than the output speed of a tube forming mill and the two may thus be operated in conjunction; it may be performed by multiple the rolling units operated in tandem; it exerts a rounding and straightening effect upon the pipe or tubing; it may be operated under automatic control; it may be employed with continuous lengths of the pipe or tubing or with discrete lengths; and it provides a greater reduction in external diameter of the pipe or tubing per pass than conventional rolling processes.

METHOD CLAIMS

The present invention comprises a method for adjusting the dimension of a pipe or tube. In one embodiment of the method, the pipe or tube is passed in continuous advance through a plurality of cylindrical rollers arranged in a parallel-cylindrical array. The plurality of cylindrical rollers is contained within a supporting cylinder. The rollers are skewed to bring the rollers into forceful contact with the external surface of the tube. The parallel-cylindrical array of rollers is rotated at a controlled speed. The degree of skewing of the rollers is controlled as follows: by first sensing the linear speed of the tube, and then controlling the speed of rotation of the rollers in relation to the linear speed of the tube. The speed of rotation of the rollers can be manually controlled or automatically controlled.

During this method, sensors sense the straightness of the tube and improve the straightness by controlling the height of a means for supporting the apparatus. The height of a means for supporting the apparatus can be controlled manually or automatically. In one aspect of this invention, the tube is not supported internally by mandrels so that controlling the pressure on the tube is necessary to prevent collapse of the tube. In another aspect of the invention, the speed of rotation of the rollers is controlled in response to the linear speed of the tube and degree of skewing of the rollers. Again the linear speed can be controlled either manually or automatically.

The rolling process of this invention can be applied to continuous lengths of the tube or to discrete lengths of pipe or tube. The path of the rollers impacts the resulting diameter of the pipe or tube. The central contact zones of the rollers describe continuous, parallel, overlapping, helical paths along the external surface of the pipe or tube and a compressive force in excess of the yield stress of its material is applied to the external surface of the pipe or tube. It is the compressive force that ultimately causes the pipe or tube to set at a smaller diameter. In addition to effecting a smaller diameter within a pipe or tube, the passage of the central contact zones of the rollers over the outer surface of the pipe or tube also corrects any out-of-roundness of the pipe or tube and causes the external surface to be burnished.

One aspect of the method of the present invention comprises the use of sensing means to sense three properties of the invention, first, sensing the speed of rotation of the rollers, second, sensing the height of the supporting means, and third, sensing the degree of skewing of the rollers. Each of these properties determines the resulting diameter and finish of the pipe or tubing. In another aspect of this invention, the tube is passed through a plurality of parallel-cylindrical arrays of rollers arranged within a supporting cylinder wherein the arrays can be rotated in alternating directions. The steps of this method can be repeated so that each pass of the tube through the array further reduces the diameter of the tube. Advantageously, the method need not include the step of lubricating the tube. In one embodiment, the method is incorporated into a tube-forming mill to provide an immediate post-fabrication treatment of the tube.

The invention claimed is:

1. Apparatus for adjusting the dimensions of a tube by rolling comprising:

a plurality of cylindrical rollers, each roller comprising a first end and a second end;

a supporting cylinder comprising a first end flange and a second end flange, at least one of the end flanges being rotationally displaceable in the supporting cylinder;

the first end flange and second end flange defining a plurality of support apertures, the ends of the rollers supported in the support apertures;

the first ends of the rollers positioned on a pitch circle and the second ends of the rollers positioned on a pitch circle of equal diameter, so that the plurality of rollers form a parallel-cylindrical array;

the first end flange defining a first tube-pass aperture and the second end flange defining a second tube-pass aperture, so that the first and second tube-pass apertures permit the tube to advance through the parallel-cylindrical array of rollers;

means for adjusting the position of at least one of the end flanges of the supporting cylinder, so that the parallel-cylindrical array is skewed;

a motor to rotate the supporting cylinder, so that the rollers apply force to the external surface of the tube;

a mounting flange comprising a mounting flange bearing, the mounting flange bearing holding the supporting cylinder, wherein the mounting flange and motor are attached to a moving frame;

means for sensing at least one of a straightness of the tube and a finished diameter of the tube; and means for controlling the speed of rotation of the rollers in relation to the linear speed of the advancing tube.

2. The apparatus of claim 1, further comprising a means for controlling the speed of the motor in response to the movement of the moving frame.

3. The apparatus of claim 2, wherein the means for controlling the speed of the motor in response to the movement of the moving frame is a pneumatic control system comprising:

an air line providing power to the motor; and a valve controlling the amount of air supplied to the air line, valve comprising a link to the moving frame, so that when the moving frame changes position, the valve is actuated to change the amount of air supplied to the motor through the air line.

4. The apparatus of claim 2, wherein the means for controlling the speed of the motor in response to the movement of the moving frame is an electrical control system that varies electrical supply to the motor when the moving frame changes position.

5. Apparatus for adjusting the dimensions of a tube by rolling comprising:

a plurality of rollers disposed in a cylindrical array, wherein the rollers are rotationally supported in end flanges of a supporting cylinder, and the ends of the rollers are positioned on pitch circles of equal diameter;

two or more bearings supported in part-spherical bushings at least partially disposed within the end flanges permitting angular displacement of the ends of the rollers relative to the end flanges, wherein at least one of the end flanges is rotationally displaceable relative to the supporting cylinder;

an aperture disposed through each end flange permitting a tube to advance through the rollers on a path coaxial with the axis of the cylindrical array;

means for adjusting the relative position of at least one of the end flanges on the supporting cylinder to displace the rollers and thereby displace a contact zone of the rollers radially inwards into forceful contact with the external surface of the tube;

means for rotationally supporting the supporting cylinder;

means for rotating the supporting cylinder, thereby causing the contact zone of the rollers to pass over and work upon the external surface of the advancing tube;

means for supporting the supporting cylinder, the end flanges, and the rollers such that the axis of the support cylinder is maintained collinear with the axis of the advancing tube; and means for determining at least one of the straightness of the tube and the finished diameter of the tube; and means for controlling at least one of the speed of rotation of the rollers in relation to the speed of advance of the tube, the height of the supporting cylinder, and the displacement of the rollers.

6. The apparatus of claim 5, further comprising two or more cylindrical arrays arranged and operated in tandem to treat the advancing pipe or tubing.

7. The apparatus of claim 6, wherein alternate cylindrical arrays are rotated in opposite directions.

8. The apparatus of claim 5, wherein the means for rotating comprises at least one of an air motor driving through a belt chain or gear, a hydraulic motor driving through a belt chain or gear, or an electric motor driving through a belt chain or gear.

9. The apparatus of claim 5, wherein the means for adjusting the relative position of at least one of the end flanges comprises one or more adjustable-length struts, and wherein the two ends of each adjustable-length strut are pivotally fixed respectively to an end flange and to the supporting cylinder.

10. The apparatus of claim 9, wherein the length of the one or more adjustable-length struts is adjusted through the use of a ball screw and nut arrangement actuated by a stepper motor.

11. The apparatus of claim 5, wherein the rollers comprise a centrally-disposed convex section or a centrally-disposed concave section.

12. The apparatus of claim 5, wherein the rollers have a diameter of about 20% of that of the tube to be worked upon.

13. The apparatus of claim 5, further comprising one or more shafts disposed at the ends of the rollers, wherein the shafts are rotationally supported in bearings at least partially disposed within the end flanges, and wherein the axial length of the shafts and bearings are sufficient in length to accommodate the axial displacement caused by the displacement of the rollers.

14. The apparatus of claim 5, wherein the supporting cylinder is fixed to the means for support with a quick-release attachment means.

15. A method for adjusting the dimensions of a tube by rolling comprising:

passing a tube through a plurality of rollers that are arranged in a cylindrical array wherein the longitudinal axis of the tube is maintained concentrically within the cylindrical array, wherein the rollers are rotationally supported in a housing and simultaneously radially displaceable;

displacing the rollers to bring the central contact zone of the rollers into forceful contact with the external surface of the tube;

rotating the cylindrical array of the rollers, thereby causing the central contact zone of the rollers to contact the external surface of the advancing tube;

sensing at least one of, the straightness of the tube, and the finished diameter of the tube; and controlling at least one of the speeds of rotation of the rollers in relation to the speed of advance of the tube, the height of the roller housing to straighten the tube, and the degree of displacement of the rollers to regulate the finished diameter of the tube.

16. The method of claim 15, wherein the tube is continuous or discrete lengths.

17. The method of claim 15, wherein passing the tube through the plurality of rollers corrects any out-of-roundness of the tube and causes the external surface of the tube to be burnished.

18. The method of claim 15, further comprising passing the tube through two or more cylindrical arrays in tandem, wherein the two or more cylindrical arrays rotate in the same direction or alternating cylindrical arrays rotate in opposite directions.

19. The method of claim 16, wherein at least one of the speed of rotation of the rollers, the height of the roller housing, and the degree of displacement of the rollers is automatically controlled.

20. The method of claim 15, wherein the advanced tube is re-passed through the rollers such that each pass of the tube through the cylindrical array further reduces the diameter of the tube.

* * * * *